United States Patent [19]

Pfeifer

[11] Patent Number: 4,861,501

[45] Date of Patent: Aug. 29, 1989

[54] STAIN RESISTANT COMPOSITION FOR SYNTHETIC ORGANIC POLYMER FIBERS AND METHOD OF USE: FLUOROCARBON POLYMER

[75] Inventor: Charles R. Pfeifer, Newport News, Va.

[73] Assignee: BASF Corporation, Williamsburg, Va.

[21] Appl. No.: 195,068

[22] Filed: May 16, 1988

[51] Int. Cl.[4] ..... D06M 13/34

[52] U.S. Cl. ..... 252/8.6; 8/115.6; 8/115.62; 8/115.64; 252/8.7; 252/8.9

[58] Field of Search ..... 252/8.7, 8.6, 8.9; 8/115.6, 115.64

[56] References Cited

U.S. PATENT DOCUMENTS

| | | | |
|---|---|---|---|
| 4,029,585 | 6/1977 | Dettre et al. | 252/8.6 |
| 4,264,484 | 4/1981 | Patel | 8/115.6 |
| 4,283,292 | 8/1981 | Marshall et al. | 252/8.8 |
| 4,325,857 | 4/1982 | Champaneria et al. | 523/412 |
| 4,340,749 | 7/1982 | Patel | 560/182 |
| 4,565,717 | 1/1986 | Hosegood et al. | 252/8.9 |
| 4,680,212 | 7/1987 | Blyth et al. | 428/97 |
| 4,781,844 | 11/1988 | Kortmann et al. | 252/8.6 |

*Primary Examiner*—A. Lionel Clingman

*Attorney, Agent, or Firm*—Edward F. Sherer

[57] ABSTRACT

An aqueous composition which is capable of rendering fibers repellant to soiling, staining, or combinations thereof. The composition comprises a rewetting agent (i.e., sodium dioctylsulfosuccinate) and a water-repelling fluoroaliphatic radical containing polymer which preferably contains 8 carbon atoms and 15 fluorine atoms.

38 Claims, No Drawings

STAIN RESISTANT COMPOSITION FOR SYNTHETIC ORGANIC POLYMER FIBERS AND METHOD OF USE: FLUOROCARBON POLYMER

BACKGROUND OF THE INVENTION

1. Field of the Invention

This invention relates to a composition for incorporation with synthetic organic polymer fibers and products thereof, i.e., yarn, to render the synthetic fibers resistant and repellant to soiling, staining, or combinations thereof.

2. Description of the Prior Art

Man-made fibers, such as nylon, polyethylene terephthalate, and acrylic fibers have found widespread use in the home and industry as carpets, drapery material, upholstery, and clothing. Many times, these materials are replaced not because the fabric wears out, but because of staining or soiling. Thus, to extend the usefulness of these materials, it is important to impart in these fibers properties that will enable them to resist staining and to release such soil when it is applied to the fabric.

The term "soil release", as used herein with reference to fibers, is used to describe fibers in which soil is released from the fibers. Soil release systems do not prevent soil from entering the fabric, but allow soil to leave the fabric.

The terms "stain" and "staining" as used herein with reference to fibers means discoloration of such fibers caused by contact of the fibers with a substance capable of causing discoloration.

The term "fiber" as used herein includes fibers of extreme or indefinite length (i.e., filaments) and fibers of short length (i.e., staple). The term "yarn" as used herein means a continuous strand of fibers.

The term "fabric" as used herein includes a textile structure composed of mechanically interlocked fibers or filaments. The structure can be nonwoven, woven, or knitted.

The treatment of various textile fibers with fluorochemicals to impart stain resistance or soil release has been known to those skilled in the art for many years. Staining and soiling can occur from either water-based or oil-based compositions. Many of these treatments utilize fluorochemicals in which soiling or staining is reduced by their ability to resist wetting by the staining or soiling material. A problem associated with such treatments is that their anti-soiling properties are unacceptable in today's market which requires products of the highest quality. For instance, many fabrics treated with fluorochemicals are still stained rather severely when contacted with oil, grease, or other oily substances such as suntan oil, shoe polish, and lipstick, and even water-based substances. This problem is particularly acute with furniture and carpet items. Oily substances are difficult to remove from these items by spot cleaning even when commercial cleaning materials are utilized. In addition, pretreatment of the soiled area prior to cleaning with an effective degreasing agent still does not ensure that the spot will be removed. This problem is aggravated by the fact that many of the fluorochemicals, by resisting wetting, do not allow penetration of the cleaning chemicals into the soiled area of the fabric.

Another problem associated with the use of many of the previously utilized fluorochemicals to impart stain or soil resistance to textile fibers is that many of them are ineffective under conditions imparting abrasive wear to the textile fibers. For instance, under abrasive wear, the fluorochemicals wear off the fibers, which results in fibers with little or no stain resistance or soil release abilities.

Thus, a need exists for durable stain resistant or soil release agents which are effective on textile fibers, yarns, and products thereof, even under high use conditions.

SUMMARY OF THE INVENTION

The surprising discovery has now been made that oil and water stain resistance and soil release can be imparted to fibers made from synthetic polymers by applying to the fibers a composition comprising an aqueous mixture of a rewetting agent and a water repelling fluorocarbon chemical. The resulting fibers are stain resistant and durably soil releasing on cleaning, which is particularly important for removing from the fibers any residual oil or water based stains.

DETAILED DESCRIPTION OF THE PREFERRED EMBODIMENTS

The water-repelling fluorocarbon chemical suitable for use in the present invention are water-repelling fluoroaliphatic radical-containing polymers.

Preferably, the fluoroaliphatic radical-containing polymers comprise one or more monomers represented by the following formula:

AM wherein:

A is a fluorinated, preferably saturated monovalent, aliphatic moiety containing from 6 to about 12 carbon atoms and from 11 to about 23 fluorine atoms; and M is a polymerizable ethylenically unsaturated moiety, preferably an acrylate or methacrylate moiety.

A can be straight, or branched and can be interrupted by divalent oxygen atoms or trivalent nitrogen atoms. Preferably, A contains a perfluoromethyl group. Preferably, AM contains at least 30 weight percent carbon bound fluorine.

More preferably, the fluoroaliphatic radical-containing polymers comprise one or more units represented by the following formula:

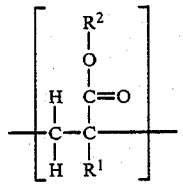

wherein $R^1$ is selected from the group consisting of hydrogen and methyl;

$R^2$ is $C_xF_{2x+1}C_nH_{2n}$;

x is a positive integer in the range of from about 5 to about 11, and, more preferably, 7 to about 9; and, n is 1 or 2.

Examples of fluoroaliphatic acrylate and methacrylate monomer units which correspond to the above formula include:

$C_5F_{11}CH_2OOCCH{=}CH_2$;

$C_5F_{11}C_2H_4OOCCH{=}CH_2$;

$C_5F_{11}CH_2OOCC(CH_3){=}CH_2$;

$C_6F_{13}CH_2OOCCH{=}CH_2$;

$C_6F_{13}C_2H_4OOCCH{=}CH_2$;

$C_6F_{13}C_2H_4OOCC(CH_3){=}CH_2$;

$C_7F_{15}CH_2OOCC(CH_3){=}CH_2$;

$C_7H_{15}C_2H_4OOCC(CH_3){=}CH_2$;

$C_7F_{15}C_2H_4OOCCH{=}CH_2$;

$C_7F_{15}CH_2OOCCH{=}CH_2$;

$C_8F_{17}C_2H_4OOCCH{=}CH_2$;

$C_8F_{17}CH_2OOCCH{=}CH_2$;

$C_8F_{17}CH_2OOCC(CH_3){=}CH_2$;

$C_8F_{17}C_2H_4OOCC(CH_3){=}CH_2$;

$C_9F_{19}CH_2OOCCH{=}CH_2$;

$C_9F_{19}CH_2OOCC(CH_3){=}CH_2$;

$C_{10}F_{21}CH_2OOCC(CH_3){=}CH_2$;

$C_{10}F_{21}C_2H_4OOCC(CH_3){=}CH_2$;

$C_{10}F_{21}CH_2OOCCH{=}CH_2$;

$C_{11}F_{23}CH_2OOCCH{=}CH_2$;

$C_{11}F_{23}CH_2OOCC(CH_3){=}CH_2$;

and mixtures thereof

Other exemplary fluoroaliphatic acrylate and methacrylate monomer units include:

$(CF_3)_2CFOC_2F_4OC_2H_4OOCC(CH_3){=}CH_2$;

$C_3F_7(\underset{\underset{CF_3}{|}}{C}FCF_2O)_2\underset{\underset{CF_3}{|}}{C}FCH_2OOCCH{=}CH_2$;

$C_2F_5C_6F_{10}CH_2OOCCH{=}CH_2$;

and mixtures thereof.

Although the fluoroaliphatic radical-containing polymers are not limited to any particular molecular weight, generally the molecular weight of the polymers will be in the range of from about 1,000 to about 100,000. The term "rewetting agent" as used herein means a hydrophilic surface active material which, after once being in solution and dried, may be softened again by rewetting. The rewetting agent imparts water absorptive qualities to the product upon which it is applied, yet is non-leachable on the product.

Examples of preferred rewetting agents include water soluble sulfonates of succinic esters such as the salts of dioctyl sulfosuccates, especially the ammonium and alkali metal salts, particularly sodium dioctyl sulfosuccinate, branched alcoholic ethoxylates, including tridecanol-6-ethoxylate, linear alcoholic ethoxylates, including nonylphenol-10-ethoxylate, such as Tergitol NPX, which is available from Union Carbide, sodium alkylaryl sulfonates, including sodium lauryl sulfonate, and mixtures thereof. A particularly preferred rewetting agent comprises about 75 percent by weight of sodium dioctyl sulfosuccinate, about 7 percent by weight of ethyl alcohol, and about 18 percent by weight of water. These percentages are based on the total weight of the rewetting agent. This rewetting agent is available from American Cyanamid as Aerosol OT-75 (aq.).

The compositions of the present invention are preferably prepared by adding the fluorocarbon to an aqueous solution containing the rewetting agent. The amount of fluorocarbon and rewetting agent utilized will vary over a wide range with no limitations. Preferably, the fluorocarbon and rewetting agents are present in the aqueous solution in an amount in the range of from about 0.1 weight percent to about 4.0 weight percent by weight of fluorocarbon based on the total weight of aqueous composition and from about 0.1 to about 4.0% by weight of rewetting agent based on the total weight of aqueous composition. More preferably, the aqueous composition comprises an aqueous solution containing from about 0.5% to about 2.0% by weight of fluorocarbon and from about 0.5% t about 2.0% by weight of rewetting agent.

The treating composition of the present invention can be applied in any manner such as by spraying the fibers, filaments, yarn, etc., or by dipping them into or otherwise contacting them with the treating composition in order to coat the surface of the fibers, filaments, yarn, etc. During the spinning of yarn, the treating composition can be applied to yarn during any of the processing stages. Furthermore, a fabric or carpet can be treated with the composition by spraying, padding, or dipping in a conventional manner. After the aqueous composition is applied to the materials, volatiles, such as water, evaporate with the resulting materials containing the rewetting agent and fluorochemical and being substantially free of volatiles. Drying of the material can be carried out by customary means such as heat ovens or air drying.

The amount of treating composition applied to the fibers varies over a wide range with no limitations. Generally, however, from about 0.1 to 1.0 percent by weight of composition (excluding volatiles such as water) is applied to the fibers and, more preferably, from about 0.2 to about 0.6 percent by weight is applied to the fibers. The resulting composition after drying will generally comprise from 15% to 85% by weight rewetting agent and from 15% to 85% by weight fluorochemical based on the dry weight of the composition.

Examples of synthetic fibers or filaments suitable for use in the invention include those of synthetic thermoplastic polymers which are capable of being processed in shaped articles, i.e., fibers, yarns, and various textile products. For example, homopolymers of olefins such as low density polyethylene, high-density polyethylene, polypropylene, copolymers of olefins with other ethylenically unsaturated monomers such as ethylenepropylene copolymer, ethylenebutene copolymer, ethylene-vinyl acetate copolymer, styrene-butadiene copolymer, acrylonitrile-styrenebutadiene copolymer and the like find application in the present invention.

Polyamides find particular application in the present invention. Examples of such polyamides include homopolyamides and copolyamides which are obtained by the polymerization of lactam or aminocaprionic acid or a copolymerization product of diamine and dicarboxylic acid.

Typical polyamides include nylon 6, nylon 6,6, nylon 6,10, nylon 6,12, nylon 11, nylon 12, and copolymers thereof or mixtures thereof. Polyamides can be also copolymers of nylon 6 or nylon 6,6 and a nylon salt obtained by reacting a dicarboxylic acid component such as terephthalic acid, isophthalic acid, adipic acid and sebacic acid with a diamine such as hexamethylenediamine, methaxylenediamine and 1,4-bisaminomethylcyclohexane.

Polyester fibers also find particular application in the present invention. The preferred polyesters are the linear terephthalate polyesters, i.e., polyesters of a glycol containing from 2 to 20 carbon atoms and a dicarboxylic acid component comprising at least about 75% terephthalic acid. The remainder, if any, of the dicarboxylic acid component may be any suitable dicarboxylic acid such as sebacic acid, adipic acid, isophthalic acid, sulfonyl-4,4-dibenzoic acid, or 2,8-di-benzofurandicarboxylic acid. Examples of linear terephthalate polyesters which may be employed include poly(ethylene terephthalate), poly(butylene terephthalate), poly(ethylene terephthalate/5-chloroisophthalate)(85/15), poly (ethyleneterephthalate/5-[sodium sulfo]isophthalate)(97/3), poly(cyclohexane-1,4-dimethylene terephthalate/hexahydroterephthalate)(75/25).

Polyacrylonitrile homopolymers and copolymers can be utilized in the present invention. The term "polyacrylonitrile" as used herein means a synthetic polymer composed of at least 85 percent by weight acrylonitrile monomer units $$(-CH_2-\underset{\underset{CN}{|}}{CH}-).$$

Up to 15 percent of the polymer can be comprised of a vinyl monomer which is copolymerizable with acrylonitrile such as methyl acrylate, methyl methacrylate, vinyl acetate, and vinyl derivatives containing sulfo or carboxyl groups.

Preferably, the polyacrylonitrile has a weight average molecular weight in the range of 50,000 to about 5,000,000, and, more preferably, has a weight average molecular weight in the range of from about 80,000 to 120,000.

In some applications, it is preferable that the polyacrylonitrile comprise at least 95 percent by weight of acrylonitrile units.

Examples of other fabric compositions include natural fibers such as wool and fabric compositions comprising polyester and cotton.

In the preferred embodiment, the agents are applied to fibers as a spin finish. The resulting fibers are then manufactured into the desired textile product which then exhibits soil and stain resistance to stain, soiling, or combinations thereof.

The following examples will serve to more comprehensively illustrate the principles of the invention, but are not intended to limit the bounds of the invention.

EXAMPLE I

A polyacrylonitrile woven canvas fabric was thoroughly scoured to remove all oily materials. Next, the fabric was evenly sprayed with a composition comprising 0.6% by weight of a fluorocarbon comprising a fluorinated alkyl polyacrylate in which the alkyl moiety contained about 8 carbon atoms and about 15 fluorine atoms and about 0.6% by weight of Aerosol OT rewetting agent. Spray application was 33% based on fabric weight so that the amounts applied based on fabric weight were each 0.2%. The fabric was then dried at 120° C. for 5 minutes and heated to 140° C. for one minute.

Next, the fabric was stained by contacting it with the following materials for a period of 16 hours: coffee, tea, catsup, mustard, chocolate, Kool Aid, milk, Coppertone dark tanning suntan oil #2, and Bain de Soleil suntan gel. Sponging of the stained fabrics with an aqueous liquid containing a mild detergent, such as "JOY®" cleaner, followed by rinsing with water and air drying of the fabric resulted in complete removal of the ingredients, except for the Coppertone oil and Bain de Soleil gel which were partially removed from the fabric. The application of "LESTOIL®" prior to carrying out the above-described cleaning procedure utilizing the mild detergent cleaner to the fabric resulted in nearly complete removal of the oily staining materials.

EXAMPLE II

An identical fabric was treated in the same manner as Example I, except that no rewetting agent was utilized in the stain removal composition. Stain removal from the fabric was the same as Example I, except that the Coppertone oil and Bain de Soleil gel were hardly removed with the mild cleaning procedure even when preceded as above with LESTOIL® cleaner.

EXAMPLE III

A series of tests was carried out to determine the effectiveness of the fluorocarbon and rewetting agent in remomving either Coppertone suntan oil #2 or Bain de Soleil gel from fabrics made from various synthetic polymer fibers.

The tests were carried out by spraying either an aqueous composition containing 0.6 percent by weight fluorocarbon (FC) or a mixture comprising 0.6 percent by weight rewetting agent and 0.6 percent by weight fluorocarbon (RW/FC) onto a strip of the fabric in an amount such that 33 percent by weight of rewetting agent or 33 percent by weight of the mixture containing the rewetting agent and fluorocarbon was present on the fabric. The fabric was then dried using hot air having a temperature of 120° to 140° C. to yield a heated fabric containing 0.2 percent by weight fluorocarbon or 0.2 percent by weight fluorocarbon and 0.2 percent by weight rewetting agent.

Next, either Coppertone oil ("A") or Bain de Soleil suntan gel ("B") was placed on the fabric. The fabric was then allowed to stand overnight. Excess compound A or B was wiped off with a dry cloth. Finally, the soiled portion of the fabric was washed with an aqueous composition containing JOY®, a mild detergent, or "PINE POWER®" cleaner which contained a degreaser. The amount of stain removal from the fabric was observed and assigned a number, which corresponds to the result set forth below in Table I.

TABLE I

| Designation | Result |
|---|---|
| 5 | Complete removal |
| 4 | Substantial removal |
| 3 | Partial removal |
| 2 | Slight removal |

TABLE I-continued

| Designation | Result |
|---|---|
| 1 | No removal |

The results of these tests are reported below in Table II.

TABLE II

| Test No. | Fabric Composition | JOY/Water Rinse RW/FC A | JOY/Water Rinse RW/FC B | JOY/Water Rinse FC A | JOY/Water Rinse FC B | PINE POWER/Water Rinse RW/FC A | PINE POWER/Water Rinse RW/FC B | PINE POWER/Water Rinse FC A | PINE POWER/Water Rinse FC B |
|---|---|---|---|---|---|---|---|---|---|
| 1 | Cotton | 1 | 1 | 1 | 1 | 3+ | 5 | 4 | 4 |
| 2 | PET/Cotton | 1 | 1+ | 1 | 1+ | 5 | 5 | 4 | 4 |
| 3 | PET | 3 | 5 | 1 | 1 | 5 | 4+ | 5 | 5 |
| 4 | Nylon | 5 | 4+ | 5 | 4 | 5 | 5 | 5 | 5 |
| 5 | Rayon | 1 | 1 | 1 | 1 | 2 | 1 | 2 | 1 |
| 6 | Wool | 2+ | 3 | 2+ | 3 | 4 | 4 | 3 | 3 |
| 7 | Acrylic | 2+ | 3+ | 1 | 1 | 5 | 5 | 5 | 5 |

The test demonstrate the benefits of the invention when cleaning fabrics comprising polyester (PET), acrylic, wool, and PET/cotton.

EXAMPLE IV

In order to determine the effectiveness of various amounts of rewetting agent or the sequence of addition of the rewetting agent (RW) and fluorochemical (FC) of Example I, fabrics comprising polyacrylonitrile fibers were soiled in the same manner as Example III after being treated with the rewetting agent and fluorochemical. The results of these tests are reported in Table III.

TABLE III

| Test No. | Treating Materials (% by weight) | Order of Treatment | Results: Joy/Water Rinse A | Joy/Water Rinse B | Pine Power/Water Rinse A | Pine Power/Water Rinse B |
|---|---|---|---|---|---|---|
| 1 | 0.2% - FC<br>0.2% - RW | Simultaneously | 2+ | 3+ | 5 | 5 |
| 2 | 0.2% - FC<br>0.2% - RW | RW - 1st<br>FC - 2nd | 2 | 2 | 5 | 5 |
| 3 | 0.2% - FC<br>0.2% - RW | FC - 1st<br>RW - 2nd | 3+ | 1 | 5 | 5 |
| 4 | 0.2% - FC<br>0.02% - RW | Simultaneously | 1 | 1 | 5 | 5 |
| 5 | 0.2% - FC<br>0.04% - RW | Simultaneously | 1 | 1 | 5 | 5 |

The tests show that the fluorocarbon and rewetting agent can be applied to the fabrics in any order. From a practical point of view, simultaneously applying the fluorocarbon and rewetting agent is generally the easiest method. In addition, greater than 0.04 percent by weight of rewetting agent must be present with 0.2 percent by weight of fluorocarbon to achieve desired cleaning results.

This invention is not limited to the above-described specific embodiments thereof; it must be understood, therefore, that the detail involved in the descriptions of the specific embodiments is presented for the purpose of illustration only, and that reasonable variations and modifications, which will be apparent to those skilled in the art, can be made in this invention without departing from the spirit and scope thereof.

What is claimed is:

1. An aqueous composition which is capable of rendering synthetic fibers repellent to soiling, staining, or combinations thereof, comprising:

(a) a rewetting agent; and, (b) a water-repelling fluorocarbon comprising a fluoroaliphatic radical-containing polymer derived from one of more monomers represented by the formula:

AM wherein:

A represents a fluorinated monovalent aliphatic moiety containing from about 6 to about 12 carbon atoms and from 11 to about 23 fluorine atoms; and, M is a polymerizable acrylate or methacrylate moiety.

2. The aqueous composition recited in claim 1 wherein said fluorinated monovalent aliphatic moiety is saturated.

3. The aqueous composition recited in claim 2 wherein said fluoroaliphatic radical-containing polymer comprises one or more units represented by the formula:

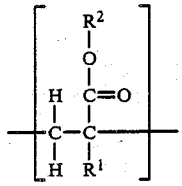

wherein $R^1$ is selected from the group consisting of hydrogen and methyl;

$R^2$ is $C_xF_{2x+1}C_nH_{2n}$;

x is an integer of from about 5 to about 11; and, n is 1 or 2.

4. The aqueous composition recited in claim 1 wherein said rewetting agent is present in an amount in the range of from about 0.1 weight percent to about 4.0 weight percent based on the total weight of said composition and said fluorocarbon is present in said composition in the range of from about 0.01 to about 4.0 weight percent based o the total weight of said composition.

5. The aqueous composition recited in claim 4 wherein said fluorocarbon is present is said aqueous composition in an amount in the range of from about 0.3 weight percent to about 2.0 weight percent based on the total weight of said aqueous composition.

6. The aqueous composition recited in claim 5 wherein said rewetting agent is present in said aqueous composition in an amount in the range of from about 0.3 weight percent to about 2.0 weight percent based on the total weight of said aqueous composition.

7. The aqueous composition recited in claim 1 wherein said fluoroaliphatic radical-containing polymer is derived from one or more monomers selected from the group consisting of $C_2F_5C_6F_{10}CH_2OOCCH{=}CH_2$;

$C_3F_7(\underset{\underset{CF_3}{|}}{C}FCF_2O)_2\underset{\underset{CF_3}{|}}{C}FCH_2OOCCH{=}CH_2$;

$(CF_3)_2CFOC_2F_4OC_2H_4OOCC(CH_3)=CH_2$;

$C_5F_{11}CH_2OOCCH=CH_2$;

$C_5F_{11}C_2H_4OOCCH=CH_2$;

$C_5H_{11}CH_2OOCC(CH_3)=CH_2$;

$C_6F_{13}CH_2OOCCH=CH_2$;

$C_6F_{13}C_2H_4OOCCH=CH_2$;

$C_6F_{13}C_2H_4OOCC(CH_3)=CH_2$;

$C_7F_{15}CH_2OOCC(CH_3)=CH_2$;

$C_7F_{15}C_2H_4OOCC(CH_3)=CH_2$;

$C_7F_{15}CH_2OOCCH=CH_2$;

$C_7F_{15}C_2H_4OOCCH=CH_2$;

$C_8F_{17}C_2H_4OOCCH=CH_2$;

$C_8F_{17}C_2H_4OOCC(CH_3)=CH_2$;

$C_8F_{17}CH_2OOCCH=CH_2$;

$C_8F_{17}CH_2OOCC(CH_3)=CH_2$;

$C_9F_{19}CH_2OOCCH=CH_2$;

$C_9F_{19}CH_2OOCC(CH_3)=CH_2$;

$C_{10}F_{21}CH_2OOCC(CH_3)=CH_2$;

$C_{10}F_{21}C_2H_4OOCC(CH_3)=CH_2$;

$C_{10}F_{21}CH_2OOCCH=CH_2$;

$C_{11}F_{32}CH_2OOCCH=CH_2$;

$C_{11}F_{23}CH_2OOCC(CH_3)=CH_2$;

and mixtures thereof.

8. The aqueous composition recited in claim 7 wherein said rewetting agent is selected from the group consisting of a water soluble sulfonates of succinic esters, linear alcoholic ethoxylates, branched alcoholic ethoxylates, sodium alkylaryl sulfonates, and mixtures thereof.

9. The aqueous composition recited in claim 1 wherein said fluoroaliphatic radical-containing polymer derived from one ar more monomers selected from the group consisting of $C_7F_{15}CH_2OOCC(CH_3)=CH_2$;

$C_7F_{15}CH_2OOCCH=CH_2$;

$C_7F_{15}C_2H_4OOCC(CH_3)=CH_2$;

$C_7F_{15}C_2H_4OOCCH=CH_2$;

$C_8F_{17}C_2H_4OOCC(CH_3)=CH_2$;

$C_8F_{17}C_2H_4OOCCH=CH_2$;

$C_8F_{17}CH_2OOCCH=CH_2$;

$C_8F_{17}CH_2OOCC(CH_3)=CH_2$;

$C_9F_{19}CH_2OOCCH=CH_2$;

$C_9F_{19}CH_2OOCC(CH_3)=CH_2$;

and mixtures thereof.

10. The aqueous composition recited in claim 9 wherein said rewetting agent is sodium dioctyl sulfosuccinate.

11. The aqueous composition recited in claim 9 wherein said rewetting agent comprises about 75 percent by weight sodium dioctyl sulfosuccinate, about 7 percent by weight ethyl alcohol, and about 18 percent by weight water, said percentages being based on the total weight of said rewetting agent.

12. The aqueous composition recited in claim 11 wherein said fluoroaliphatic radical-containing polymer has a molecular weight in the range of from about 1,000 to about 100,000.

13. A fiber having resistance to soiling, staining or combinations thereof, characterized by having a coating on the surface thereof of an effective amount of a composition comprising:

(a) a rewetting agent; and, (b) a water-repelling fluorocarbon comprising a fluoroaliphatic radical-containing polymer derived from one or more monomers represented by the formula:

AM wherein:

A represents a fluorinated monovalent aliphatic moiety containing from about 6 to about 12 carbon atoms and from 11 to about 23 fluorine atoms; and, M is a polymerizable acrylate or methacrylate moiety.

14. The fiber recited in claim 13 wherein said fluoroaliphatic radical-containing polymer comprises units represented by the formula:

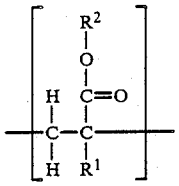

wherein $R^1$ is selected from the group consisting of hydrogen and methyl;

$R^2$ is $C_xF_{2x+1}C_nH_{2n}$;

x is an integer of from about 5 to about 11; and, n is 1 or 2.

15. The fiber recited in claim 14 wherein said fiber is coated on the surface with said composition in an amount of from about 0.1 to about 1.0 percent of said composition excluding volatiles based on the weight of said fiber.

16. A yarn comprising the fibers of claim 15.

17. A fabric comprising the fibers of claim 15.

18. The fiber recited in claim 13 wherein said fluoroaliphatic radical-containing polymer is derived from one or more monomers selected from the group consisting of $C_2F_5C_6F_{10}CH_2OOCCH=CH_2$;

-continued $C_3F_7(CF(CF_3)CF_2O)_2CF(CF_3)CH_2OOCCH{=}CH_2$;

$(CF_3)_2CFOC_2F_4OC_2H_4OOCC(CH_3){=}CH_2$;

$C_5F_{11}CH_2OOCCH{=}CH_2$;

$C_5F_{11}C_2H_4OOCCH{=}CH_2$;

$C_5F_{11}CH_2OOCC(CH_3){=}CH_2$;

$C_6F_{13}CH_2OOCCH{=}CH_2$;

$C_6F_{13}C_2H_4OOCCH{=}CH_2$;

$C_6F_{13}C_2H_4OOCC(CH_3){=}CH_2$;

$C_7F_{15}CH_2OOCC(CH_3){=}CH_2$;

$C_7F_{15}C_2H_4OOCC(CH_3){=}CH_2$;

$C_7F_{15}CH_2OOCCH{=}CH_2$;

$C_7F_{15}C_2H_4OOCCH{=}CH_2$;

$C_8F_{17}C_2H_4OOCCH{=}CH_2$;

$C_8F_{17}C_2H_4OOCC(CH_3){=}CH_2$;

$C_8F_{17}CH_2OOCCH{=}CH_2$;

$C_8F_{17}CH_2OOCC(CH_3){=}CH_2$;

$C_9F_{19}\ CH_2OOCCH{=}CH_2$;

$C_9F_{19}CH_2OOCC(CH_3){=}CH_2$;

$C_{10}F_{21}CH_2OOCC(CH_3){=}CH_2$;

$C_{10}F_{21}\ C_2H_4OOCC(CH_3){=}CH_2$;

$C_{10}F_{21}CH_2OOCCH{=}CH_2$;

$C_{11}F_{23}CH_2OOCCH{=}CH_2$;

$C_{11}F_{23}CH_2OOCC(CH_3){=}CH_2$;

and mixtures thereof.

19. The fiber recited in claim 18 wherein said coating by said composition comprises from about 15 to about 85 percent rewetting agent and 15 to about 85 percent by weight fluorocarbon based on the total dry weight of said composition.

20. The fiber recited in claim 19 wherein said rewetting agent is selected from the group consisting of a water soluble sulfonates of succinic esters, linear alcoholic ethoxylates, branched alcoholic ethoxylates, sodium alkylaryl sulfonates, and mixtures thereof.

21. The fiber recited in claim 20 wherein said fluoroaliphatic radical-containing polymer is derived from one or more monomers selected from the group consisting of $C_7F_{15}CH_2OOCCH{=}CH_2$;

$C_7F_{15}CH_2OOCC(CH_3){=}CH_2$;

$C_7F_{15}C_2H_4OOCC(CH_3){=}CH_2$;

$C_7F_{15}C_2H_4OOCCH{=}CH_2$;

$C_8F_{17}C_2H_4OOCCH{=}CH_2$;

$C_8F_{17}CH_2OOCCH{=}CH_2$;

$C_8F_{17}CH_2OOCC(CH_3){=}CH_2$;

$C_8F_{17}C_2H_4OOCC(CH_3){=}CH_2$;

$C_9F_{19}CH_2OOCCH{=}CH_2$;

$C_9F_{19}CH_2OOCC(CH_3){=}CH_2$;

and mixtures thereof.

22. The yarn recited in claim 21 wherein said rewetting agent is a water sale of dioctyl sulfosuccinate.

23. The fiber recited in claim 21 wherein said rewetting agent comprises about 75 percent by weight sodium dioctyl sulfosuccinate, about 7 percent by weight ethyl alcohol, and about 18 percent by weight water, said percentages being based on the total weight of said rewetting agent.

24. The fiber recited in claim 23 comprising synthetic organic polymers selected from the group consisting of polyester, polyamide, polyacrylonitrile, wool, and mixtures thereof.

25. The fiber recited in claim 23 wherein said polymer is polyacrylonitrile.

26. The fiber recited in claim 25 wherein said fluoraliphatic radical containing polymer is derived from one or more monomers selected from the group consisting of $C_8F_{17}C_2H_4OOCCH{=}CH_2$;

$C_8F_{17}CH_2OOCCH{=}CH_2$;

$C_8F_{17}CH_2OOCC(CH_3){=}CH_2$;

$C_8F_{17}C_2H_4OOCC(CH_3){=}CH_2$;

and mixtures thereof.

27. A yarn comprising the fibers of claim 26.

28. A fabric comprising the fibers of claim 26.

29. A method of preparing a fiber which is resistant to soiling, staining, or combinations thereof comprising:

contacting said yarn with an aqueous composition containing:

(a) a rewetting agent; and, (b) a water-repelling fluorocarbon comprising a fluoroaliphatic radical-containing polymer derived from one or more monomers represented by the formula:

AM wherein:

A represents a fluorinated monovalent aliphatic moiety containing from about 6 to about 12 carbon atoms and from 11 to about 23 fluorine atoms; and, M is a polymerizable acrylate or methacrylate moiety.

30. The method recited in claim 29 wherein said fluoroaliphatic radical-containing polymer contains units represented by the formula:

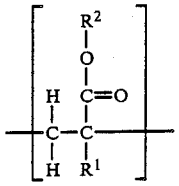

wherein $R^1$ is selected from the group consisting of hydrogen and methyl;

$R^2$ is $C_xF_{2x+1}C_nH_{2n}$;

x is an integer of from about 5 to about 11; and, n is 1 or 2.

31. The method recited in claim 30 wherein said rewetting agent is present in said aqueous composition in an amount in the range of from about 0.01 weight percent to about 4.0 weight percent based on the total weight of said composition and said fluorocarbon is present in said aqueous composition in an amount in the range of from about 0.01 weight percent to about 4.0 weight percent based on the total weight of said composition.

32. The method recited in claim 29 wherein said fluoroaliphatic radical-containing polymer is derived from one or more monomers selected from the group consisting of:

$C_2F_5C_6F_{10}CH_2OOCCH{=}CH_2$;

$C_3F_7(\underset{\underset{CF_3}{|}}{C}FCF_2O)_2\underset{\underset{CF_3}{|}}{C}FCH_2OOCCH{=}CH_2$;

$(CF_3)_2CFOC_2F_4OC_2H_4OOCC(CH_3){=}CH_2$;

$C_5F_{11}CH_2OOCCH{=}CH_2$;

$C_5F_{11}C_2H_4OOCCH{=}CH_2$;

$C_5F_{11}CH_2OOCC(CH_3){=}CH_2$;

$C_6F_{13}CH_2OOCCH{=}CH_2$;

$C_6F_{13}C_2H_4OOCCH{=}CH_2$;

$C_6F_{13}C_2H_4OOCC(CH_3){=}CH_2$;

$C_7F_{15}CH_2OOCC(CH_3){=}CH_2$;

$C_7F_{15}CH_2OOCCH{=}CH_2$;

$C_7F_{15}C_2H_4OOCC(CH_3){=}CH_2$;

$C_7F_{15}C_2H_4OOCCH{=}CH_2$;

$C_8F_{17}C_2H_4OOCCH{=}CH_2$;

$C_8F_{17}CH_2OOCCH{=}CH_2$;

$C_8F_{17}CH_2OOCC(CH_3){=}CH_2$;

$C_8F_{17}C_2H_4OOCC(CH_3){=}CH_2$;

$C_9F_{19}CH_2OOCCH{=}CH_2$;

$C_9F_{19}CH_2OOCC(CH_3){=}CH_2$;

$C_{10}F_{21}CH_2OOCC(CH_3){=}CH_2$;

$C_{10}F_{21}C_2H_4OOCC(CH_3){=}CH_2$;

$C_{10}F_{21}CH_2OOCCH{=}CH_2$;

$C_{11}F_{23}CH_2OOCCH{=}CH_2$;

$C_{11}F_{23}CH_2OOCCH(CH_3){=}CH_2$;

and mixtures thereof.

33. The method recited in claim 32 wherein said rewetting agent is selected from the group consisting of a water soluble sulfonates of succinic esters, linear alcoholic ethoxylates, branched alcoholic ethoxylates, sodium alkylaryl sulfonates, and mixtures thereof.

34. The method recited in claim 33 wherein said fluoroaliphatic radical-containing polymer is derived from one or more monomers selected from the group consisting of $C_7F_{15}CH_2OOCC(CH_3){=}CH_2$;

$C_7F_{15}C_2H_4OOCC(CH_3){=}CH_2$;

$C_7H_{15}CH_2OOCCH{=}CH_2$;

$C_7F_{15}C_2H_4OOCCH{=}CH_2$;

$C_8F_{17}C_2H_4OOCCH{=}CH_2$;

$C_8F_{17}CH_2OOCCH{=}CH_2$;

$C_8F_{17}CH_2OOCC(CH_3){=}CH_2$;

$C_8F_{17}C_2H_4OOCC(CH_3){=}CH_2$;

$C_9F_{19}CH_2OOCCH{=}CH_2$;

$C_9F_{19}CH_2OOCC(CH_3){=}CH_2$;

and mixtures thereof.

35. The method recited in claim 34 wherein said fiber comprise synthetic organic polymers selected from the group consisting of polyester, polyamide, polyacrylonitrile, wool, and mixtures thereof.

36. The method recited in claim 35 wherein said rewetting agent is a water soluble salt of dioctyl sulfosuccinate.

37. The method recited in claim 36 wherein said fluoroaliphatic radical-containing polymer is derived from one or more monomers selected from the group consisting of $C_8F_{17}C_2H_4OOCCH{=}CH_2$;

$C_8F_{17}CH_2OOCCH{=}CH_2$;

$C_8F_{17}CH_2OOCC(CH_3){=}CH_2$;

$C_8F_{17}C_2H_4OOCC(CH_3){=}CH_2$;

and mixtures thereof.

38. A yarn or fabric comprising fibers of claim 37.

* * * * *